US006215386B1

(12) United States Patent
Gokita et al.

(10) Patent No.: US 6,215,386 B1
(45) Date of Patent: Apr. 10, 2001

(54) COIL DEVICE

(75) Inventors: Katsuhiro Gokita; Mutsumi Kinoshita; Hiroshi Sasai; Kazuhiko Umeda; Tadashi Fukuda; Toshio Chamura, all of Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/427,083

(22) Filed: Oct. 26, 1999

(51) Int. Cl.[7] ..... H01F 27/28
(52) U.S. Cl. ..... 336/182; 336/180; 336/188
(58) Field of Search ..... 333/119, 131; 336/188, 220, 221, 212, 180, 182

(56) References Cited

U.S. PATENT DOCUMENTS

| | | | | |
|---|---|---|---|---|
| 2,883,604 | * | 4/1959 | Mortimer | 336/188 |
| 3,012,177 | * | 12/1961 | Mortimer | 336/188 |
| 4,052,785 | * | 10/1977 | Duncan | 336/221 |
| 5,705,961 | * | 1/1998 | Yee | 336/221 |

FOREIGN PATENT DOCUMENTS

| | | |
|---|---|---|
| 52-104837 | 9/1977 | (JP) . |
| 53-32345 | 3/1978 | (JP) . |
| 62-32514 | 2/1987 | (JP) . |
| 2-25213 | 7/1990 | (JP) . |

* cited by examiner

*Primary Examiner*—Anh Mai
(74) *Attorney, Agent, or Firm*—Oblon, Spivak, McClelland, Maier, & Neustadt, P.C.

(57) ABSTRACT

A combined-type coil device provided with a core, a first coil and a second coil, where the core is provided with at least four through holes and the through holes are roughly parallel to one another. When a combination of two through holes constitutes a first through holes pair and the combination of the remaining two through holes constitutes a second through holes pair, a center line passing through the centers of the holes in the first through hole pair and a center line passing through the centers of the holes in the second through hole pair extend almost perpendicular to each other. The first coil passes through the first through hole pair, whereas the second coil passes through the second through hole pair.

12 Claims, 11 Drawing Sheets

COIL DEVICE

BACKGROUND OF THE INVENTION

1. Field of the Invention

The present invention relates to a coil device, and more specifically, it relates to a coil device provided with a plurality of coils at a single core.

2. Discussion of Background

A circuit which is achieved by connecting a plurality of coil devices being independent of one another is employed in various types of circuit apparatuses. For instance, a circuit having a common mode choke coil connected to the secondary winding of a transformer is employed in transmission apparatuses such as a LAN apparatus.

In a standard manufacturing process of a prior art circuit, a transformer and a common mode choke coil are manufactured separately and therefore mounted onto a circuit board separately. Not only does this require numerous mounting steps, but also limits the degree to which high density mounting is possible since a large area on the circuit board for mounting these parts is occupied.

SUMMARY OF THE INVENTION

It is an object of the present invention to provide a coil device that makes it possible to reduce the number of required parts by half.

It is a further object of the present invention to provide a coil device with which an improvement is achieved in the mounting density on a circuit board or the like.

It is a still further object of the present invention to provide a coil device achieving a high degree of magnetic efficiency.

It is a still further object of the present invention to provide a coil device with which it is possible to minimize the magnetic coupling among a plurality of coils.

In order to achieve the objects described above, the coil device according to the present invention includes a core, a first coil and a second coil.

The core is provided with at least four through holes. The through holes are provided roughly parallel to one another with a combination of two through holes among them constituting a first through hole pair and a combination of the remaining two through holes constituting a second through hole pair. These achieve a relationship whereby the center line passing through the centers of the through holes in the first through hole pair extends almost perpendicular to the center line passing through the centers of the through holes in the second through hole pair. The first coil passes through the first through hole pair whereas the second coil passes through the second through hole pair.

By adopting such a structure, it is possible to share the core between the first coil and the second coil to achieve a reduction in the number of required parts by half and to achieve an improvement in the mounting density on a circuit board or the like. Also, a toroidal—type closed magnetic circuit is formed by the core relative to the first coil and the second coil. As a result, the magnetic flux leaking to the outside is reduced and magnetic efficiency is improved.

With the through holes and the coils as described, it is possible to ensure that the magnetic flux generated by the current flowing to the first coil does not interlink with the second coil and that the magnetic flux generated by the current flowing to the second coil does not interlink with the first coil. Thus, it is possible to minimize the magnetic coupling between the first coil and the second coil.

The quantity of through holes, their positions and the like may be varied in a number of ways while ensuring that the requirements described above are satisfied. In addition, a number of different modes may be adopted in regard to the shape of the core member, its structure and the like. The present invention discloses examples of such variations and modes.

The first coil and the second coil each typically include two windings to constitute a transformer or a common mode choke coil. According to the present invention, the first coil and the second coil may be connected with each other on the core, or they may be connected outside, at a circuit board, a terminal plate or the like.

In another mode, the core may include a first core member and a second core member which are coupled with each other. By adopting this structure, magnetic characteristics that are suited for the individual coils, i.e., the first coil and the second coil, can be achieved.

According to the present invention, a coil refers to a component that is constituted by winding a wire and a winding refers to the wire member constituting the coil.

BRIEF DESCRIPTION OF THE DRAWINGS

Other objects, structural features and advantages of the present invention are explained in further detailed by referring to the attached drawings. It is to be noted that the attached drawings are provided simply to illustrate examples.

DETAILED DESCRIPTION OF THE PREFERRED EMBODIMENTS

Figure 1:
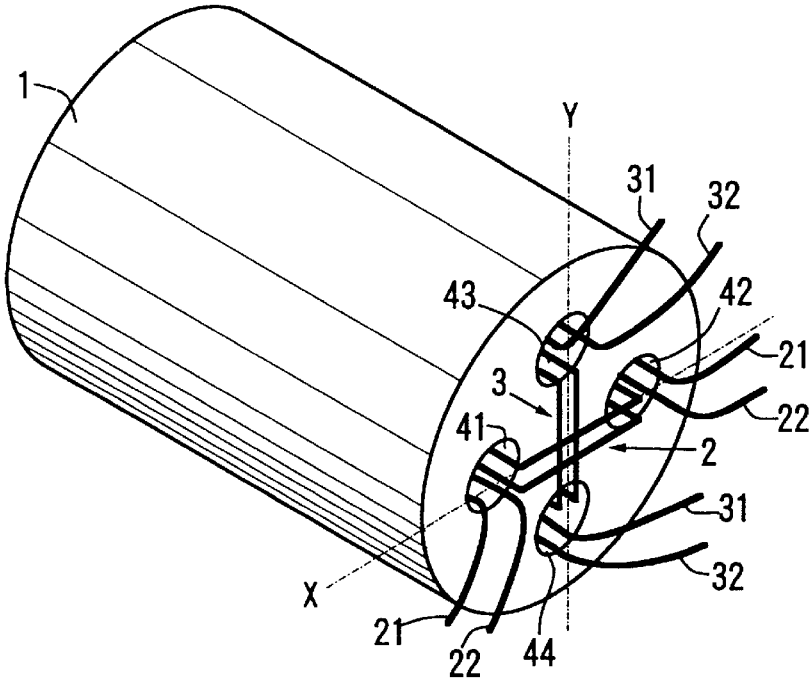
FIG. 1 is a perspective of the coil device according to the present invention.
Figure 2:
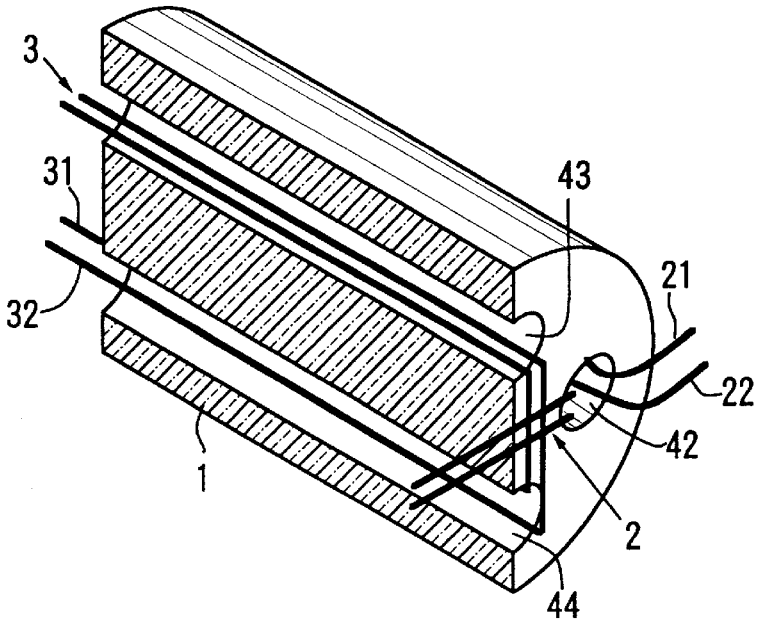
FIG. 2 is a perspective of a half section of the coil device shown in FIG. 1.
Figure 3:
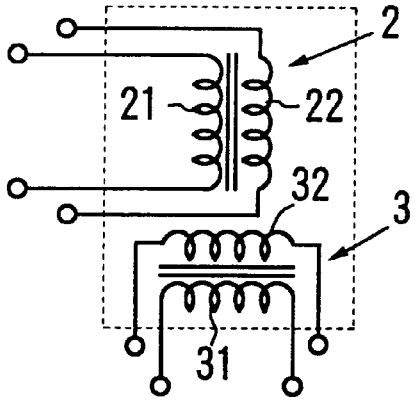
FIG. 3 is an electrical circuit diagram of the coil device shown in FIGS. 1 and 2.

Referring to FIGS. 1 to 3, the coil device according to the present invention includes a core 1, a first coil 2 and a second coil 3.

The core 1 is provided with at least four through holes 41 to 44. The through holes 41 to 44 are provided roughly parallel to one another. The through holes 41 to 44 are formed so that when a combination of two selected through holes among the through holes 41 to 44 constitutes a first through hole pair 41 and 42 and a combination of the remaining two through holes constitutes a second through hole pair 43 and 44. A center line X passing through the centers of the first through hole pair 41 and 42 and a center line Y passing through the centers of the second through hole pair 43 and 44 extend almost perpendicular to each other.

The first coil 2 is wound by passing through the first through hole pair 41 and 42, whereas the second coil 3 is wound by passing through the second through hole pair 43 and 44. The number of turns of the first coil 2 and the second coil 3 is arbitrary. In addition, the directions in which their ends are lead out may be set freely.

By adopting the structure as described above, it is possible to share the core 1 between the first coil 2 and the second coil 3 to achieve a reduction in the number of required parts by half and to achieve an improvement in the mounting density on a circuit board or the like.

Also, a toroidal—type closed magnetic circuit is formed by the core 1 relative to the first coil 2 and the second coil 3. As a result, the magnetic flux leaking to the outside is reduced and magnetic efficiency is improved.

By adopting the structure of the through holes 41 to 44, as described above, it is possible to ensure that the interlinkage of the magnetic flux generated by the current flowing to the first coil 2 is minimized and at the same time, the interlinkage of the magnetic flux generated by the current flowing to the second coil 3 is minimized. Thus, it is possible to minimize the degree of magnetic coupling between the first coil 2 and the second coil 3. The center lines X and Y do not need to extend exactly perpendicular to each other. They are only required to intersect each other at an angle at which the magnetic coupling of the first coil 2 and the second coil 3 is slight enough to be essentially disregarded.

In the embodiment illustrated in FIGS. 1 to 3, the individual holes in the second through hole pair 43 and 44 are formed on the two sides of the center line X passing through the first through hole pair 41 and 42. This placement of the through holes 43 and 44 minimizes the overall size of the coil device.

In addition, two ends of each of windings 21 and 22 constituting the first coil 2 are independent of each other. As a result, a transformer with the winding 21 constituting a primary winding and the winding 22 constituting a secondary winding, for instance, can be realized. By increasing the number of windings constituting the first coil 2, a transformer achieving a required winding structure with a tertiary winding, a quaternary winding and the like, for instance, can be realized.

In the second coil 3, too, the two ends of each of the windings 31 and 32 are independent of each other. Consequently, it is possible to achieve a coil 3 in which the windings 31 and 32 are independent of each other. A typical example of such a second coil 3 is a common mode choke coil.

Figure 4:
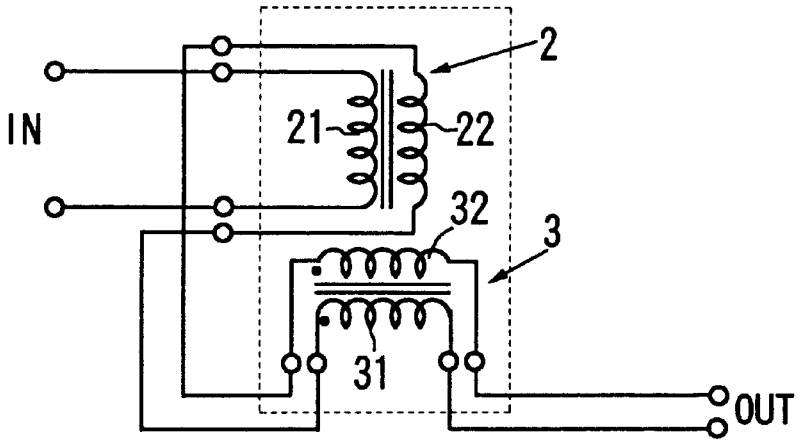
FIG. 4 is an electrical circuit diagram of a structure employing the second coil as a common mode choke coil.

FIG. 4 is an electrical circuit diagram illustrating a structure which utilizes the second coil 3 as a common mode choke coil. In this embodiment, the winding 21 and the winding 22 of the first coil 2 constitute a primary winding and a secondary winding respectively, one end of the winding 31 constituting the second coil 3 is connected to one end of the winding 22 (secondary winding) constituting the first coil 2 and one end of the winding 32 is connected to the other end of the winding 22 (secondary winding) constituting the first coil 2. A signal input (IN) from the winding 21 (primary winding) of the first coil 2 is output (OUT) through the other end of the winding 31 and the other end of the winding 32.

Figure 5:
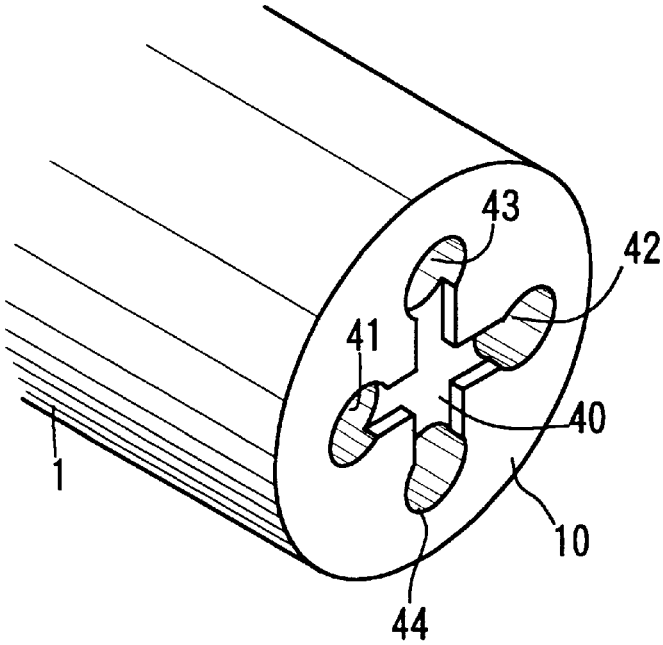
FIG. 5 is a perspective illustrating another example of the core member constituting the coil device according to the present invention.

Referring to FIG. 5, the core 1 is provided with a coil guide groove 40 at an end surface 10 at which the through holes 41 to 44 open. The first coil 2 and the second coil 3 can be wound around through the coil guide groove 40 at the end surface where the through holes 41 to 44 open. Thus, miniaturization can be achieved by ensuring that the first coil 2 and the second coil 3 do not project out while protecting the first coil 2 and second coil 3. The coil guide groove 40 should be formed by ensuring that its bottom surface is at a position lower than the end surface 10 and connects the through holes 41 and 42 or the through holes 43 and 44. The shape of the coil guide groove 40 is not restricted to the example shown in the figure.

The core 1 may be constituted of an insulating sintered magnetic substance such as ferrite. The first coil 2 and the second coil 3 can be directly wound around the core 1 constituted of such an insulating sintered magnetic substance. If the core 1 is constituted of a material having a degree of electrical conductivity that cannot be disregarded in terms of electrical insulation of the first coil 2 and the second coil 3, an insulating film should be formed at, at least, the surface areas of the core that come in contact with the first coil 2 and the second coil 3, including the inner surfaces of the through holes 41 to 44. The insulating film may be constituted of an insulating resin film or an inorganic insulating film such as glass.

Figure 6:
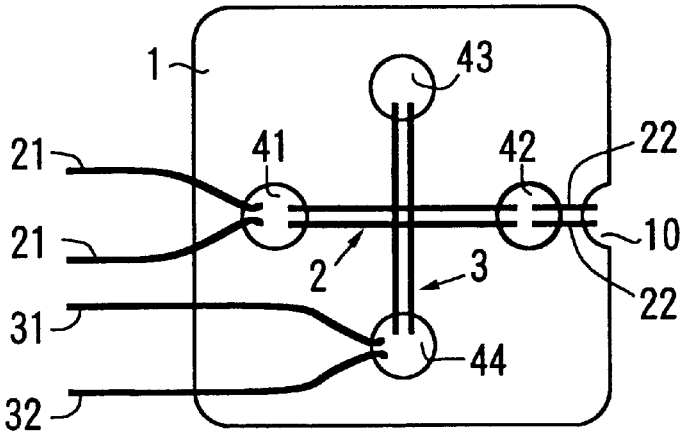
FIG. 6 is a front view of another embodiment of the coil device according to the present invention.
Figure 7:
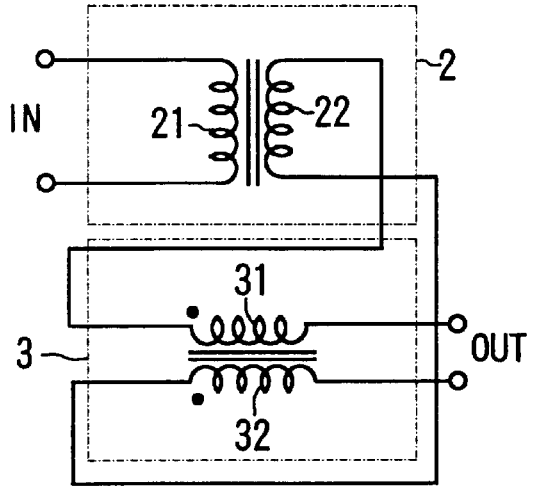
FIG. 7 is an electrical circuit diagram of the coil device shown in FIG. 1.

Referring to FIGS. 6 and 7, the core 1 is provided with a groove 10 extending along the direction in which the through holes 41 to 44 are provided, at the outer surface of the core. The two windings 31 and 32 constituting the second coil 3 are each connected to an end of the winding 22 constituting the first coil 2 through the groove 10. A signal input (IN) through the winding 21 (primary winding) of the first coil 2 is output (OUT) through the other end of the winding 31 and the other end of the winding 32.

Figure 8:
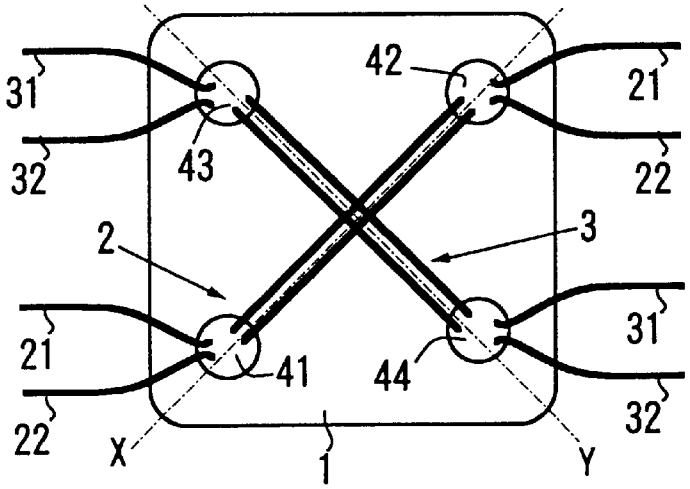
FIG. 8 is a front view of yet another embodiment of the coil device according to the present invention.

Referring to FIG. 8, wherein the same reference numbers are assigned to components identical to those illustrated in FIGS. 1 to 3, the external shape of the core 1 is rectangular, with the first through hole pair 41 and 42 and the second through hole pair 43 and 44 provided along the directions of the diagonal lines. This embodiment, too, achieves advantages similar to those described earlier in reference to FIGS. 1 to 3.

Figure 9:
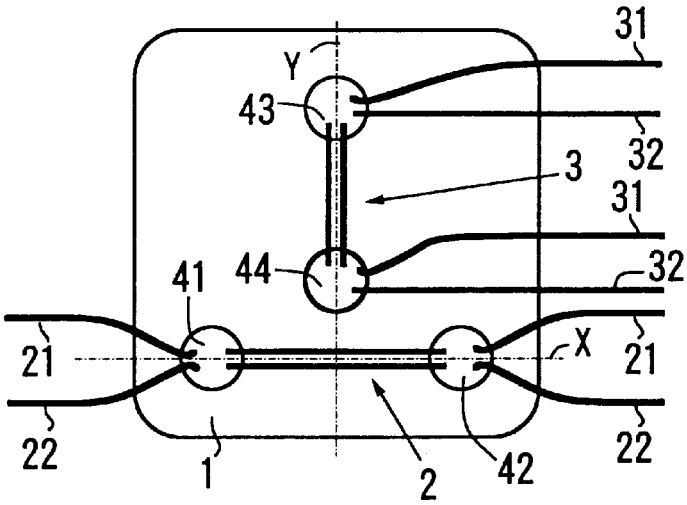
FIG. 9 is a front view of yet another embodiment of the coil device according to the present invention.

Referring to FIG. 9, wherein the same reference numbers are assigned to components identical to those illustrated in FIGS. 1 to 8, the second through hole pair 43 and 44 is provided on one side of the center line X of the first through hole pair 41 and 42. This embodiment, too, achieves advantages similar to those described earlier in reference to FIGS. 1 to 3.

Figure 10:
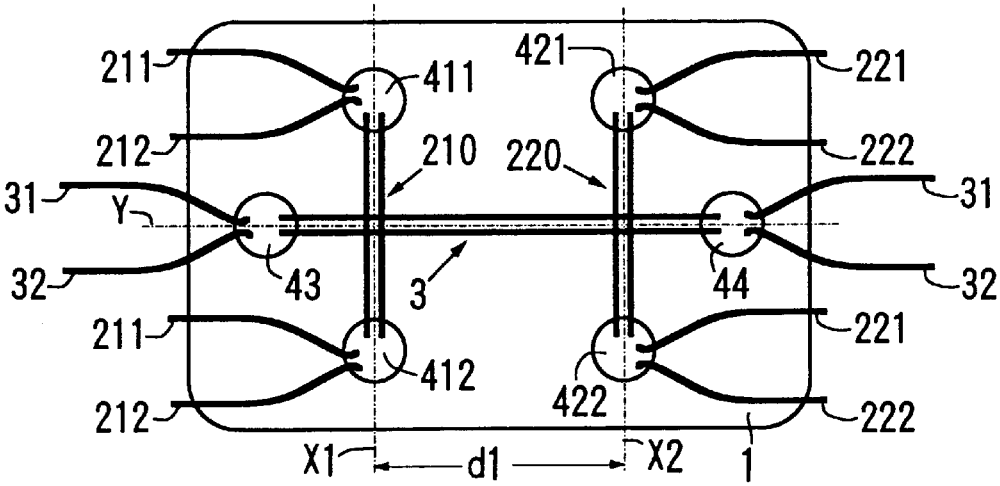
FIG. 10 is a front view of yet another embodiment of the coil device according to the present invention.

Referring to FIG. 10, wherein the same reference numbers are assigned to components identical to those illustrated in FIGS. 1 to 8, a plurality of first through hole pairs (411 and 412) and (421 and 422) are provided. A first coil 210 is provided at the first through hole pair 411 and 412, and a first coil 220 is provided at the first through hole pair 421 and 422. The first coil 210 includes a plurality of windings 211 and 212 that are independent of the each other, whereas the first coil 220 includes a plurality of windings 221 and 222 that are independent of each other.

A center line X1 passing through the centers of the holes in the first hole pair 411 and 412 extends almost perpendicular to the center line Y passing through the centers of the holes in the second through hole pair 43 and 44. A center line X2 passing through the centers of the holes in the first hole pair 421 and 422, too, extends almost perpendicular to the center line Y passing through the centers of the holes in the second through hole pair 43 and 44. The first through hole pairs (411 and 412) and (421 and 422) are formed over a distance dl from each other along the direction in which the center line Y passing through the centers of the holes in the second through hole pair 43 and 44 provided for the second coil 3 extends.

Figure 11:
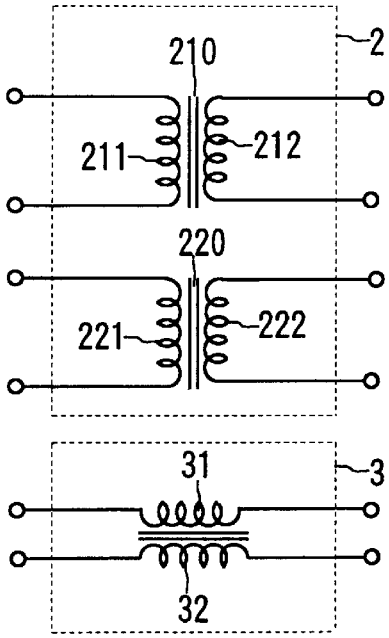
FIG. 11 is an electrical circuit diagram of the coil device shown in FIG. 10.

Referring to FIG. 11, a transformer having two coils 210 and 220 is formed in the embodiment shown in FIG. 10. At the coil 210, the winding 211 constitutes a primary winding and the winding 212 constitutes a secondary winding. At the coil 220, the winding 221 constitutes a primary winding and the winding 222 constitutes a secondary winding.

If the second coil 3 constitutes a common mode choke coil, its windings 31 and 32 are connected to the secondary winding constituted of the winding 212 or the secondary winding constituted of the winding 222 at one end.

Figure 12:
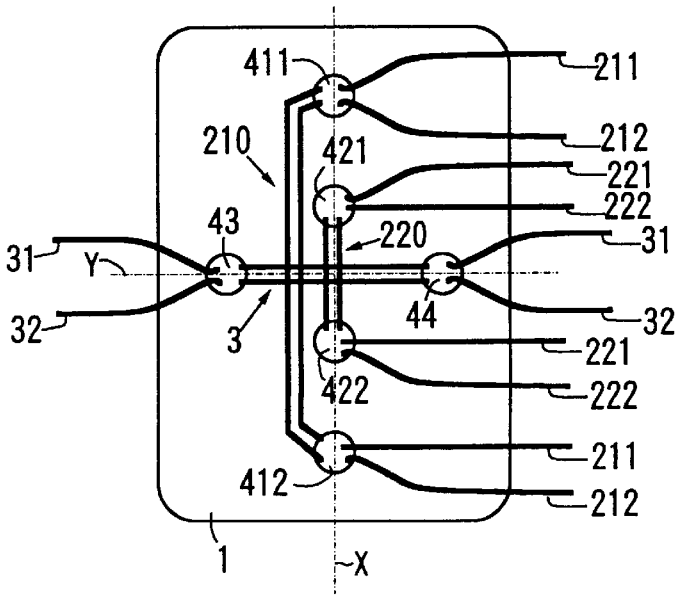
FIG. 12 is a front view of yet another embodiment of the coil device according to the present invention.

Referring to FIG. 12, wherein the same reference numbers are assigned to components identical to those illustrated in FIG. 10, the first through hole pairs (411 and 412) and (421 and 422) are provided on the center line X, which extends almost perpendicular to the center line Y passing through the centers of the holes in the second through hole pair 43 and 44 provided for the second coil 3.

Figure 13:
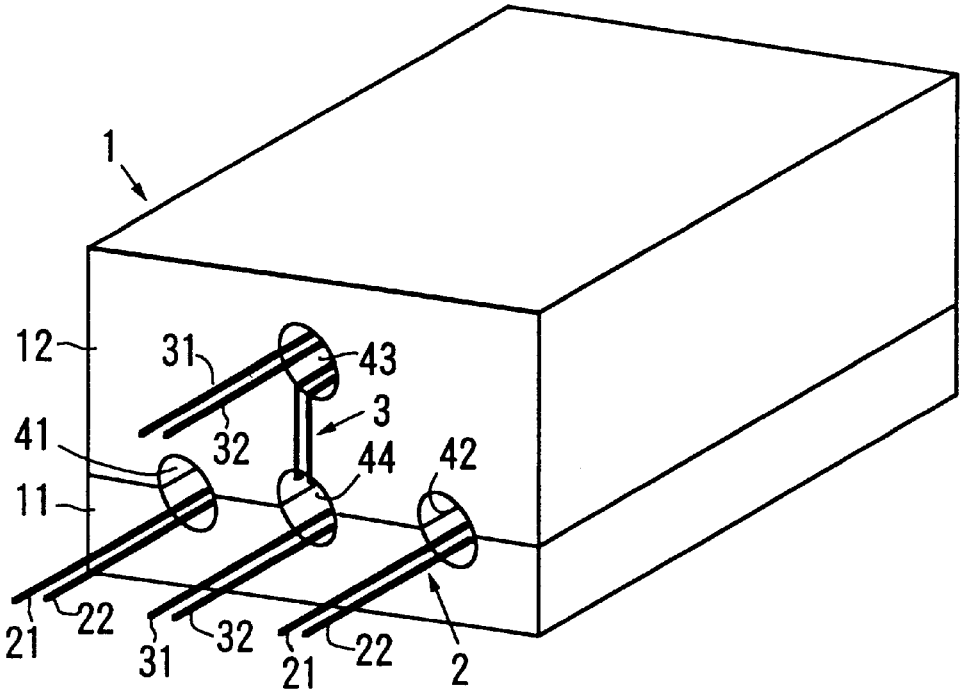
FIG. 13 is a perspective of yet another embodiment of the coil device according to the present invention.
Figure 14:
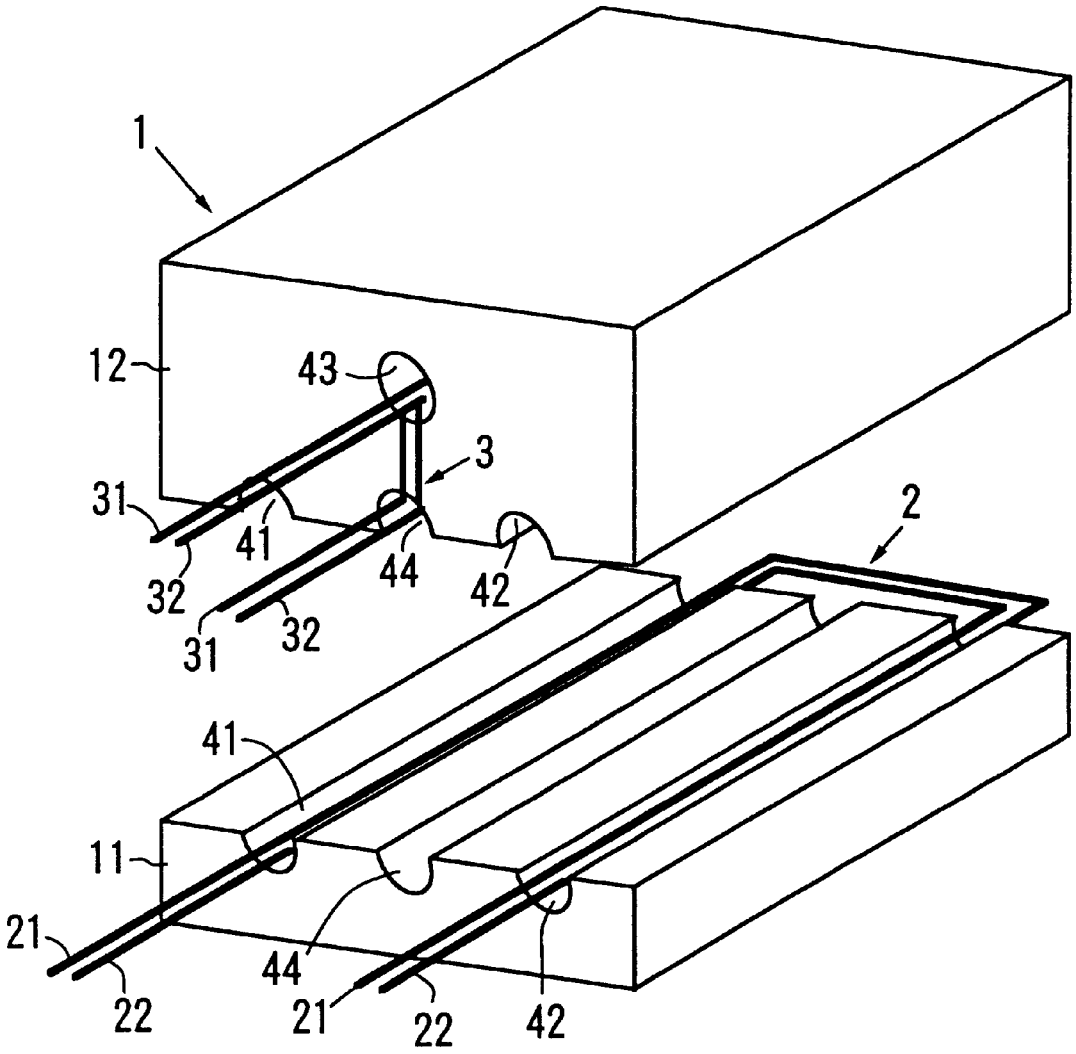
FIG. 14 is an exploded perspective of the coil device shown in FIG. 13.

Referring to FIGS. 13 and 14, the core 1 includes a first core member 11 and a second core member 12. The first core member 11 and the second core member 12 are coupled through surface contact, with the first through hole pair 41 and 42 for the first coil 2 provided at the coupling surface.

At the coupling surface, the through hole 44 in the second through hole pair 43 and 44 for the second coil 3 is also provided. The through hole 43 alone is provided at the second core member 12. By adopting this structure, the materials to constitute the first core member 11 and second core number 12 may be selected independently of each other to achieve magnetic characteristics that suit the individual coils, i.e., the first coil 2 and the second coil 3. For instance, the first core member 11 may be constituted by employing a material achieving a high initial magnetic permeability, with the second core member 12 constituted of a material with an initial magnetic permeability lower than that of the material constituting the first core member 11.

Figure 15:
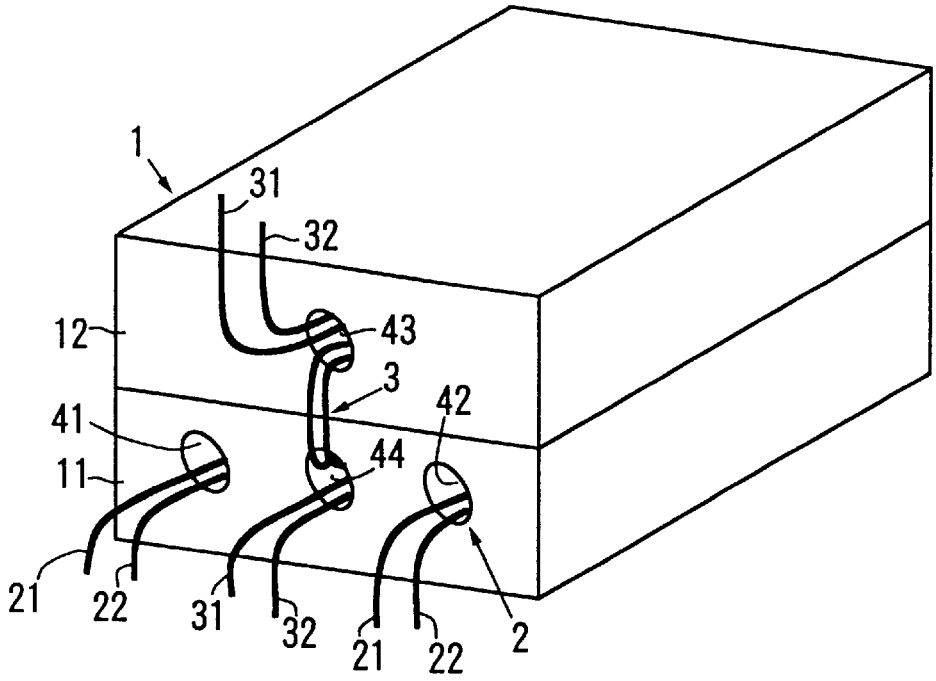
FIG. 15 is a perspective of yet another embodiment of the coil device according to the present invention.

Referring to FIG. 15, the first core member 11 and the second core member 12 are coupled with each other through surface contact. The first through hole pair 41 and 42 provided for the first coil 2 and the through hole 44 provided for the second coil 3 are provided at the first core member 11. The through hole 43 in the second through hole pair 43 and 44 is provided at the second core member 12. Through this structure, too, advantages similar to those explained earlier in reference to FIGS. 13 and 14 are achieved.

Figure 16:
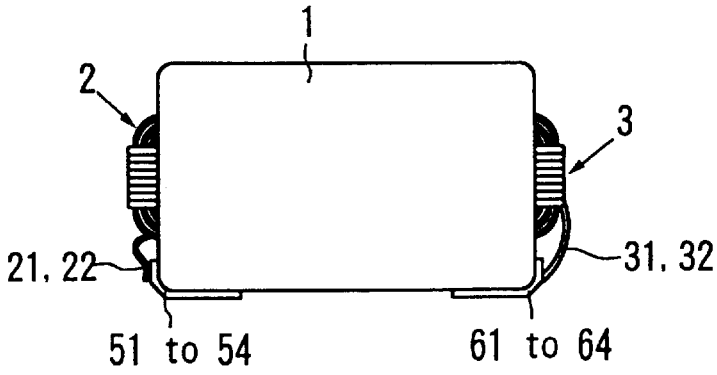
FIG. 16 is a side view of the coil device according to the present invention.
Figure 17:
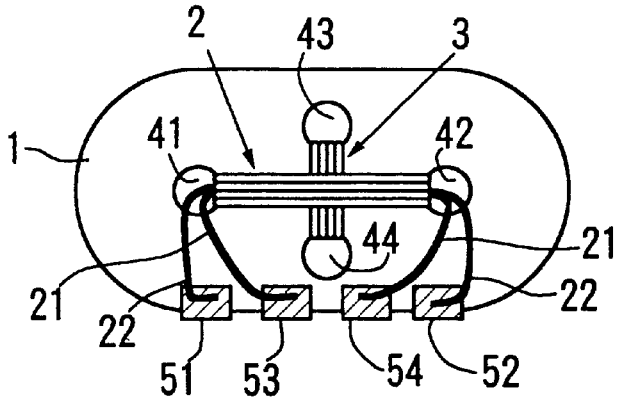
FIG. 17 is a front view of the coil device shown in FIG. 16.
Figure 18:
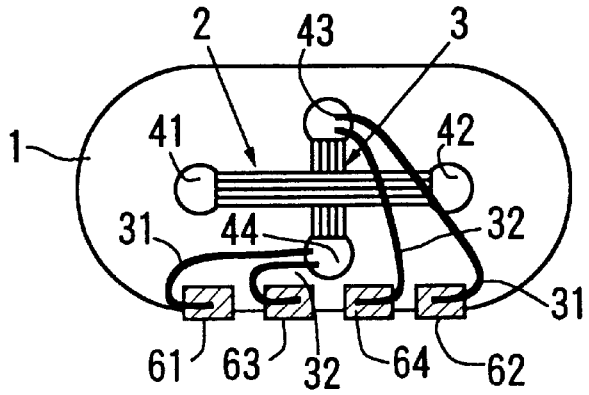
FIG. 18 is a rear view of the coil device shown in FIG. 16.

Referring to FIGS. 16 to 18, the coil device includes a plurality of terminal electrodes (51 to 54) and (61 to 64). The four ends of the windings 21 and 22 constituting the first coil 2 are respectively connected to the terminal electrodes 51 to 54. The four ends of the windings 31 and 32 constituting the second coil 3 are respectively connected to the terminal electrodes 61 to 64. The terminal electrodes (51 to 54) and (61 to 64) are utilized to affix the coil device at a conductor pattern provided at a board through a means such as soldering when mounting the coil device at the board. In the embodiment, the terminal electrodes (51 to 54) and (61 to 64) are formed at appropriate positions at the lower surface or the like of the core 1, achieving electrical insulation. Such terminal electrodes (51 to 54) and (61 to 64) may be formed by means such as plating or baking of coated conductive paste or the like.

Figure 19:
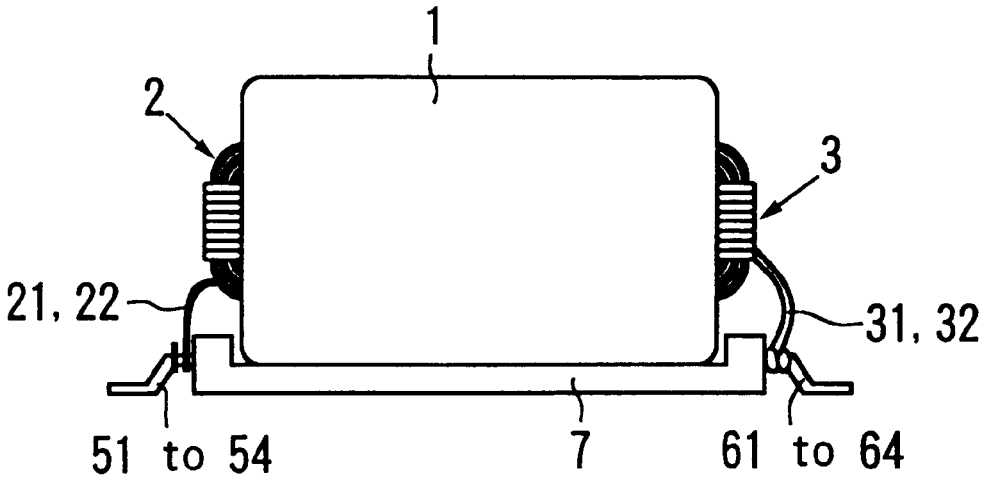
FIG. 19 is a side view of another embodiment of the coil device according to the present invention.

Referring to FIG. 19, the coil device is provided with an insulating support body 7. The core 1 is mounted on one surface of the insulating support body 7 through bonding or by a means of mechanical coupling. The terminal electrodes (51 to 54) and (61 to 64) are mounted at the insulating support body 7. The four ends of the windings 21 and 22 constituting the first coil 2 are respectively connected to the terminal electrodes 51 to 54. The four ends of the windings 31 and 32 constituting the second coil 3 are respectively connected to the terminal electrodes 61 to 64.

While no further explanation or illustration is presented, it is obvious that there may be a number of variations of the present invention achieved by combining the individual embodiments.

What is claimed is:

1. A coil device comprising:

a core having at least four through holes that are provided substantially parallel to one another and are formed so that, with a combination of two through holes among said four through holes constituting a first through hole pair and a combination of another two through holes constituting a second through hole pair, a center line passing through centers of said through holes in said first through hole pair and a center line passing through centers of said through holes in said second through hole pair extend substantially perpendicular to each other;

a first coil passing through said first through hole pair, said first coil including a primary winding and a secondary winding; and a second coil passing through said second through hole pair, said second coil including a primary winding and a secondary winding.

2. The coil device of claim 1, wherein said through holes in said second through hole pair are provided separately to the two sides relative to said center line passing through said first through hole pair.

3. The coil device of claim 1, wherein said second through hole pair is provided at one side relative to said center line passing through said first through hole pair.

4. The coil device of claim 1, wherein a plurality of first through hole pairs are provided.

5. The coil device of claim 1, wherein said first coil includes a plurality of windings that are independent of one another.

6. The coil device of claim 5, wherein said first coil constitutes a transformer.

7. The coil device of claim 1, wherein said second coil includes a plurality of windings that are independent of one another.

8. The coil device of claim 7, wherein said second coil constitute a common mode choke coil.

9. The coil device of claim 7, wherein said plurality of windings constituting said second coil are each connected to either end of one of said windings constituting said first coil at one end.

10. The coil device of claim 9, wherein said core is provided with a groove extending along the direction of said through holes at an outer surface thereof; and said plurality of windings constituting said second coil are each connected to either end of one of said windings constituting said first coil through said groove.

11. The coil device of claim 1, wherein said core includes a first core member and a second core member that are coupled with each other;

said first through hole pair is provided at said first core member; and at least one through hole in said second through hole pair is provided at said second core member.

12. The coil device of claim 11, wherein only one through hole in said second through hole pair is provided at said second core member and the other through hole in said second through hole pair is provided at a coupling surface where said first core member and said second or member are coupled with each other.

* * * * *